US009657426B2

(12) United States Patent
Chung et al.

(10) Patent No.: US 9,657,426 B2
(45) Date of Patent: May 23, 2017

(54) WASHING MACHINE AND CONTROL METHOD FOR THE SAME

(71) Applicant: LG Electronics Inc., Seoul (KR)

(72) Inventors: Bosun Chung, Gyeongnam (KR); Kihoon Choi, Gyeongnam (KR); Soonan Park, Gyeongnam (KR)

(73) Assignee: LG Electronics Inc., Seoul (KR)

( * ) Notice: Subject to any disclaimer, the term of this patent is extended or adjusted under 35 U.S.C. 154(b) by 911 days.

(21) Appl. No.: 14/023,605

(22) Filed: Sep. 11, 2013

(65) Prior Publication Data

US 2014/0083142 A1 Mar. 27, 2014

(30) Foreign Application Priority Data

Sep. 24, 2012 (KR) ..... 10-2012-0105692

(51) Int. Cl.
*D06F 35/00* (2006.01)
*D06F 33/02* (2006.01)
*D06F 37/20* (2006.01)

(52) U.S. Cl.
CPC ..... *D06F 35/007* (2013.01); *D06F 33/02* (2013.01); *D06F 37/203* (2013.01); *D06F 2202/065* (2013.01); *D06F 2204/065* (2013.01); *D06F 2222/00* (2013.01)

(58) Field of Classification Search
CPC ..... D06F 35/007; D06F 33/02; D06F 37/203; D06F 2222/00
See application file for complete search history.

(56) References Cited

U.S. PATENT DOCUMENTS 5,720,066 A 2/1998 Kim
6,240,586 B1 * 6/2001 Joo ..... D06F 33/02 68/12.06
2012/0303163 A1 * 11/2012 Compains Pascualena ..... D06F 35/007 700/275

FOREIGN PATENT DOCUMENTS

| | | |
|---|---|---|
| CN | 1085265 | 5/2002 |
| CN | 201195795 | 2/2009 |
| JP | 61-125387 A | 6/1986 |
| JP | H 11-309293 A | 11/1999 |
| JP | 2010-075217 A | 4/2010 |
| JP | 2011-045618 A | 3/2011 |
| KR | 10-2000-0043393 A | 7/2000 |
| KR | 10-2001-0048546 | 6/2001 |

OTHER PUBLICATIONS

Australian Office Action dated May 2, 2015 for Australian Application No. 2013228067, 4 pages.

* cited by examiner

*Primary Examiner* — Joseph L Perrin
(74) *Attorney, Agent, or Firm* — Fish & Richardson P.C.

(57) ABSTRACT

A washing machine is capable of determining whether measured vibration has been caused by noise or by rotation of the inner tub. The washing machine measures vibration occurring during rotation of the inner tub and performs control operation to address causes of vibration or prevent the washing machine from toppling in the case that the vibration has actually been caused by rotation of the inner tub.

20 Claims, 8 Drawing Sheets

(a)

(b)

WASHING MACHINE AND CONTROL METHOD FOR THE SAME

This application claims the benefit of Korean Patent Application No. 10-2012-0105692, filed on Sep. 24, 2012, which is hereby incorporated by reference as if fully set forth herein.

FIELD

The present disclosure relates to a washing machine and a control method for the same.

BACKGROUND

Depending on functions of treating laundry (objects to be washed), washing machines can be classified into a washer and a dryer. A washer performs a washing operation of removing contaminants from objects to be washed using washing water, and a dryer performs a drying operation of removing moisture from the objects to be washed. Recently, a washer provided with an integrated drying function is under development.

Meanwhile, washing machines can be classified into a top loading type and a front loading type. In the case of the top loading type, the introduction port through which the laundry is introduced is provided on the top of the cabinet. In the case of the front loading type, the introduction port through which the laundry is introduced is provided at the front side (or lateral side) of the cabinet.

The top loading type washing machine includes a cabinet forming the external appearance of the washing machine, an outer tube provided in the cabinet, and an inner tub provided in the outer tub.

In the case of the top loading type washing machine, the outer tub is arranged perpendicular to the ground, and the inner tub is arranged to rotate about a rotating shaft perpendicular to the ground in the outer tub.

In addition, positioned at the top of the cabinet are an introduction port for introduction of laundry into the inner tub, and a cover provided with a door to open and close the introduction port.

The top loading type washing machine performs washing or drying of the laundry through rotation of the inner tub. However, if the inner tub rotates with the objects to be washed non-uniformly distributed in the inner tub (e.g., in the case that the inner tub rotates in an unbalanced state), the inner tub vibrates.

In this case, the inner tub may collide with the outer tub. When the inner tub collides with the outer tub, the outer tub may in turn collide with the cabinet, resulting in separation of the cover from the cabinet or causing the door provided to the cover to open.

In addition, when vibration by rotation of the inner tub is transferred to the outer tub and the cabinet, loud noise may be produced, and the washing machine may even fall over depending on the extent of vibration.

SUMMARY

In one aspect, a control method for a washing machine includes periodically measuring vibration occurring in at least one of a cabinet of the washing machine and an outer tub provided in the cabinet to receive washing water and, based on the periodic measurement of vibration, determining a first element frequency using first vibration data and determining a second element frequency using second vibration data. The first vibration data is different than the second vibration data, the first vibration data includes vibration data measured after all of the second vibration data, and the second vibration data includes vibration data measured prior to all of the first vibration data. The control method also includes determining vibration change data as a magnitude of a value obtained by subtracting the second element frequency from the first element frequency and determining whether the vibration change data meets a predetermined reference frequency. The control method further includes interrupting power to a drive unit for rotating an inner tub of the washing machine based on a determination that the vibration change data meets the reference frequency and accounting for whether the vibration change data meeting the reference frequency was caused by noise. The accounting includes determining an initial frequency corresponding to a time at which power to the drive unit was interrupted and determining a cumulative frequency as a sum of most recently measured vibration data and a certain number of vibration data measurements that occurred prior to the most recently measured vibration data. The accounting also includes determining a value obtained by subtracting the initial frequency from the cumulative frequency and determining whether the value obtained by subtracting the initial frequency from the cumulative frequency meets a predetermined reference noise frequency. The accounting further includes resupplying power to the drive unit based on a determination that the value obtained by subtracting the initial frequency from the cumulative frequency does not meet the predetermined reference noise frequency and displaying information indicating occurrence of an error through an alarm unit associated with the washing machine based on a determination that the value obtained by subtracting the initial frequency from the cumulative frequency meets the predetermined reference noise frequency.

Implementations may include one or more of the following features. For example, the control method may include determining, prior to interrupting power to the drive unit, a rate of increase of revolutions per minute of the inner tub and determining whether the rate of increase of revolutions per minute of the inner tub meets a reference rate of increase. In this example, the control method may include, based on a determination that the rate of increase of revolutions per minute of the inner tub meets the reference rate of increase, setting the predetermined reference frequency to 6 Hz.

In some implementations, the control method may include determining, prior to interrupting power to the drive unit, a rate of increase of revolutions per minute of the inner tub and determining whether the rate of increase of revolutions per minute of the inner tub meets a reference rate of increase. In these implementations, the control method may include, based on a determination that the rate of increase of revolutions per minute of the inner tub does not meet the reference rate of increase, setting the predetermined reference frequency to 8 Hz.

In addition, the control method may include determining the initial frequency as a cumulative frequency measured based on vibration data measured during rotation of the inner tub being within a predetermined range for a certain time. Further, the control method may include determining whether revolutions per minute (RPM) of the inner tub meets a first reference RPM value, where determining whether the vibration change data meets the predetermined reference frequency is performed based on a determination that the RPM of the inner tub meets the first reference RPM value.

In some examples, the control method may include, based on a determination that the value obtained by subtracting the initial frequency from the cumulative frequency does not meet the predetermined reference noise frequency, comparing a total time for which the inner tub has rotated at an RPM that meets a normal RPM value with a predetermined accumulated time and terminating operation of the washing machine based on a determination that total time for which the inner tub has rotated at an RPM that meets the normal RPM value meets the predetermined accumulated time. In these examples, the control method may include resupplying power to the drive unit based on a determination that total time for which the inner tub has rotated at an RPM that meets the normal RPM value does not meet the predetermined accumulated time.

In some implementations, the control method may include updating a number of executions of resupplying power to the drive unit based on a determination that total time for which the inner tub has rotated at an RPM that meets the normal RPM value does not meet the predetermined accumulated time and determining whether the updated number of executions meets a predetermined reference number of executions. In these implementations, the control method may include resupplying power to the drive unit based on a determination that the updated number of executions does not meet the predetermined reference number of executions, and displaying information indicating occurrence of an error through the alarm unit based on a determination that the updated number of executions meets the predetermined reference number of executions.

The control method may include comparing an RPM of the inner tub measured before the power to the drive unit is interrupted with a predetermined second reference RPM value based on a determination that the value obtained by subtracting the initial frequency from the cumulative frequency meets the predetermined reference noise frequency. The control method also may include displaying information indicating occurrence of an error through the alarm unit based on the comparison revealing that the RPM of the inner tub measured before the power to the drive unit is interrupted is greater than the second reference RPM value. The control method further may include resupplying power to the drive unit based on the comparison revealing that the RPM of the inner tub measured before the power to the drive unit is interrupted is equal to or less than the second reference RPM value.

In some examples, the control method may include performing an operation directed to reducing unbalance in the inner tub based on the comparison revealing that the RPM of the inner tub measured before the power to the drive unit is interrupted is equal to or less than the second reference RPM value and resupplying power to the drive unit after termination of the operation directed to reducing unbalance in the inner tub. In these examples, the control method may include supplying washing water to the outer tub, supplying power to the drive unit and rotating the inner tub, and interrupting the power supplied to the drive unit and discharging the washing water from the outer tub. Also, in these examples, the control method may include updating a number of times of sensing unbalance based on the comparison revealing that the RPM of the inner tub measured before the power to the drive unit is interrupted is equal to or less than the second reference RPM value and determining whether the number of times of sensing unbalance meets a predetermined reference number of times. Further, in these examples, the control method may include performing the operation directed to reducing unbalance in the inner tub based on a determination that the number of times of sensing unbalance meets the predetermined reference number of times and resupplying power to the drive unit based on a determination that the number of times of sensing unbalance does not meet the predetermined reference number of times.

In some implementations, the control method may include determining an incremental change of the cumulative frequency as updated according to a period of creation of vibration data and determining whether the incremental change of the cumulative frequency as updated according to the period of creation of vibration data meets a predetermined reference toppling frequency. In these implementations, the control method may include resupplying power to the drive unit based on a determination that the incremental change of the cumulative frequency as updated according to the period of creation of vibration data does not meet the predetermined reference toppling frequency. Also, in these implementations, the control method may include displaying the information indicating occurrence of an error through the alarm unit based on a determination that the incremental change of the cumulative frequency as updated according to the period of creation of vibration data meets the predetermined reference toppling frequency.

In some examples, the control method may include setting a reference sensing frequency to a value obtained by subtracting a least element frequency from a greatest element frequency among two or more element frequencies and determining the incremental change of the cumulative frequency as a magnitude of a value obtained by subtracting the reference sensing frequency from the cumulative frequency. In these examples, the control method may include determining whether the reference sensing frequency meets a predetermined reference value of incremental change and updating the reference sensing frequency according to the period of creation of the vibration data. Also, in these examples, the control method may include setting the reference sensing frequency to a cumulative frequency at a current time based on a determination that the reference sensing frequency does not meet predetermined reference value of incremental change and setting the reference sensing frequency to a cumulative frequency before the current time based on a determination that the reference sensing frequency meets the reference value of incremental change. Further, in these examples, the control method may include setting the reference sensing frequency to the value obtained by subtracting a least element frequency from a greatest element frequency among two or more element frequencies comprises setting the reference sensing frequency to the value obtained by subtracting the least element frequency from the greatest element frequency among the first element frequency, the second element frequency, a third element frequency, and a fourth element frequency, wherein, the third element frequency is defined as a sum of the number of vibration data used to set the first element frequency among a plurality of vibration date measured prior to the second element frequency, and the fourth element frequency is defined as a sum of the number of vibration data used to set the first element frequency among a plurality of vibration date measured prior to the third element frequency.

The control method may include determining whether the vibration change data is equal to or greater than the predetermined reference frequency. The control method also may include determining whether the value obtained by subtracting the initial frequency from the cumulative frequency is equal to or greater than the predetermined reference noise frequency. The control method further may include periodically measuring vibration occurring in the outer tub provided in the cabinet to receive washing water.

In another aspect, a washing machine includes a cabinet, an outer tub provided in the cabinet to receive washing water, and an inner tub provided in the outer tub. The washing machine also includes a drive unit for rotating the inner tub and a vibration sensor configured to periodically measure vibration occurring in at least one of the cabinet of the washing machine and the outer tub provided in the cabinet to receive washing water. The washing machine is configured to, based on the periodic measurement of vibration, determine a first element frequency using first vibration data and determine a second element frequency using second vibration data. The first vibration data is different than the second vibration data, the first vibration data includes vibration data measured after all of the second vibration data, and the second vibration data includes vibration data measured prior to all of the first vibration data. The washing machine is configured to determine vibration change data as a magnitude of a value obtained by subtracting the second element frequency from the first element frequency and determine whether the vibration change data meets a predetermined reference frequency. The washing machine is configured to interrupt power to the drive unit for rotating the inner tub of the washing machine based on a determination that the vibration change data meets the reference frequency and account for whether the vibration change data meeting the reference frequency was caused by noise. The accounting includes determining an initial frequency corresponding to a time at which power to the drive unit was interrupted and determining a cumulative frequency as a sum of most recently measured vibration data and a certain number of vibration data measurements that occurred prior to the most recently measured vibration data. The accounting also includes determining a value obtained by subtracting the initial frequency from the cumulative frequency and determining whether the value obtained by subtracting the initial frequency from the cumulative frequency meets a predetermined reference noise frequency. The accounting further includes resupplying power to the drive unit based on a determination that the value obtained by subtracting the initial frequency from the cumulative frequency does not meet the predetermined reference noise frequency and displaying information indicating occurrence of an error through an alarm unit associated with the washing machine based on a determination that the value obtained by subtracting the initial frequency from the cumulative frequency meets the predetermined reference noise frequency.

Both the foregoing general description and the following detailed description are exemplary and explanatory and are intended to provide further explanation of the subject matter claimed.

DETAILED DESCRIPTION

Figure 1:
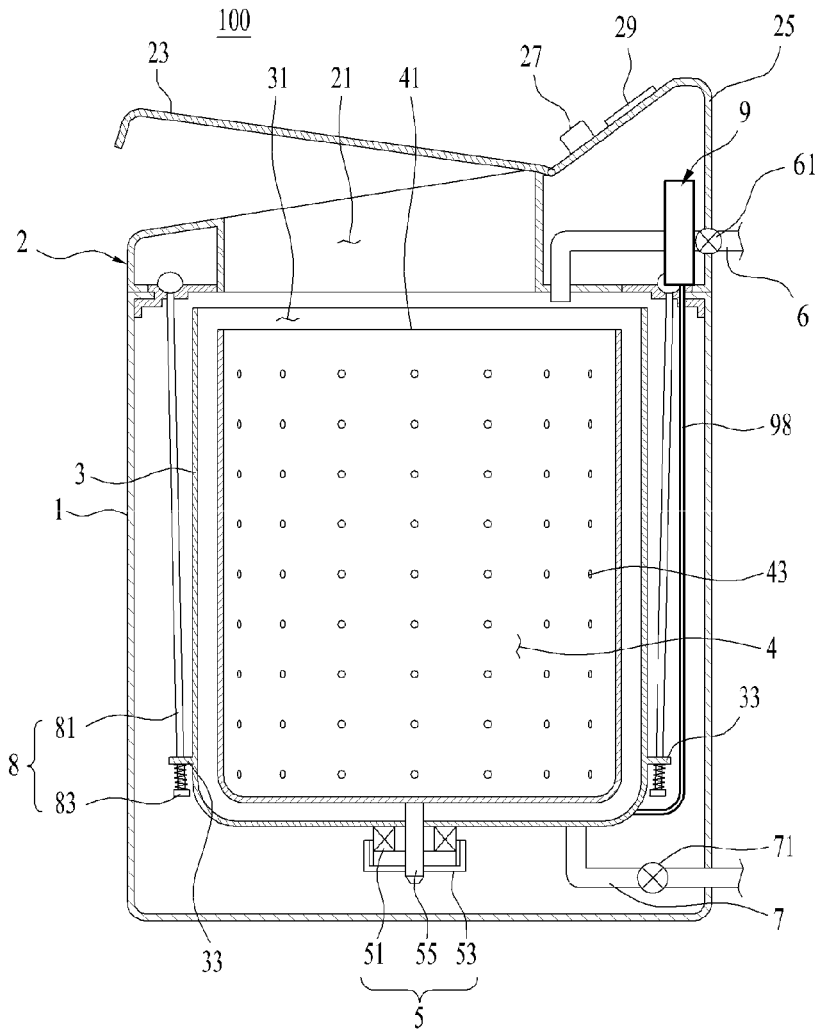
FIG. 1 is a view illustrating an example structure of an example washing machine.

As shown in FIG. 1, an appearance of an example washing machine 100 is formed by a cabinet 1 provided with an open upper surface and a cover 2 provided on the open upper surface of the cabinet.

The cabinet 1 may have the shape of a column having an open upper surface and a hollow inner space. Provided in the cabinet 1 are an outer tub 3 to receive washing water, and an inner tub 4 rotatably provided in the outer tub to receive objects to be washed.

The outer tub 3 and the inner tub 4 may be formed in the shape of a cylinder having an open upper surface. That is, the upper surface of the outer tub 3 is provided with a first opening 31, and the upper surface of the inner tub 4 is provided with a second opening 41 corresponding to an introduction port 21.

The inner tub 4 is provided with a plurality of through holes 43. The washing water contained in the outer tub 3 is introduced from the outer tub 3 to the inner tub 4 or is discharged from the inner tub 4 to the outer tub 3, through the through holes 43.

In addition, the cover 2 is provided to the open upper surface of the cabinet such that the outer tub 3 and the inner tub 4 are not exposed outside of the cabinet. The cover 2 is provided with the introduction port 21, through which the objects to be washed are introduced into the inner tub 4 or are retrieved from the inner tub and a door 23 to open and close the introduction port 21.

In addition, the cover 2 is provided with a control panel 25 having a controller. The control panel 25 may be provided with an input unit 27 through which control commands are input to the washing machine 100, and an alarm unit to inform the user of information about operation of the washing machine 100.

The alarm unit may be provided with a display unit 29 to display information about the operations of the washing machine or the process of treating the objects to be washed, and a speaker to inform the user of completion of control commands set by the user and errors occurring in the washing machine.

The inner tub 4 is rotated by a drive unit 5 positioned at the exterior of the outer tub 3. The drive unit 5 may be provided with a stator 51 fixed to the lower surface of the outer tub 3, a rotor 53 to rotate through electromagnetic interaction with the stator 51, and a rotating shaft 55 to connect the rotor 53 with the bottom surface of the inner tub 4.

Further, washing water needed for washing operation is supplied to the outer tub 3 through a water supply unit, and is discharged from the outer tub 3 through the drainage unit.

The water supply unit may be provided with a water supply channel 6 connected to a water source, and a water supply valve 61 provided in the water supply channel 6.

In this case, the water supply valve 61 is caused to open and close the water supply channel 6 by the controller. Accordingly, when the user inputs a control command for water supply through the input unit 27, the controller opens the water supply valve 61 such that washing water is supplied to the outer tub 3.

The drainage unit is provided with a drainage channel 7 connected to the lower surface of the outer tub 3, and a drainage valve 71 to open and close the drainage channel 7. The controller causes the drainage valve 71 to open and close the drainage channel 7.

The outer tub 3 is elastically supported against the interior of the cabinet 1 by a tub support portion 8.

That is, the outer tub 3 may be provided with a flange 33 protruding from the outer circumferential surface of the outer tub 3. The tub support portion 8 may be provided with a bar-shaped rod 81 arranged to penetrate the flange 33 to connect the cabinet 1 with the outer tub 3, and an elastic member 83 (such as a spring) arranged between one end of the rod 81 and the flange 33.

Accordingly, when the outer tub 3 is vibrated by rotation of the inner tub 4, the outer tub 3 may be stably supported in the cabinet 1.

In addition, the washing machine 100 is provided with a vibration sensor 9 to measure vibration of the outer tub 3.

The vibration sensor 9 measures vibration caused by rotation of the inner tub 4. The vibration sensor 9 may be fixed to the outer circumferential surface of the outer tub 3, the cabinet 1, or the cover 2.

Hereinafter, a description is provided assuming that the vibration sensor 9 is fixed to the cabinet 1. Other placements of the vibration sensor are possible.

The vibration sensor 9 may have any structure capable of measuring vibration of the cabinet 1 or the outer tub 3 caused by rotation of the inner tub 4.

To determine whether vibration data (such as frequencies) measured through the vibration sensor 9 represents actual vibration caused by rotation of the inner tub 4 or caused by noise from electronic equipment installed in the washing machine, the vibration sensor 9 include a magnetic force sensing unit which is capable of sensing change in magnetic force depending on the position of a magnetic member.

Figure 2:
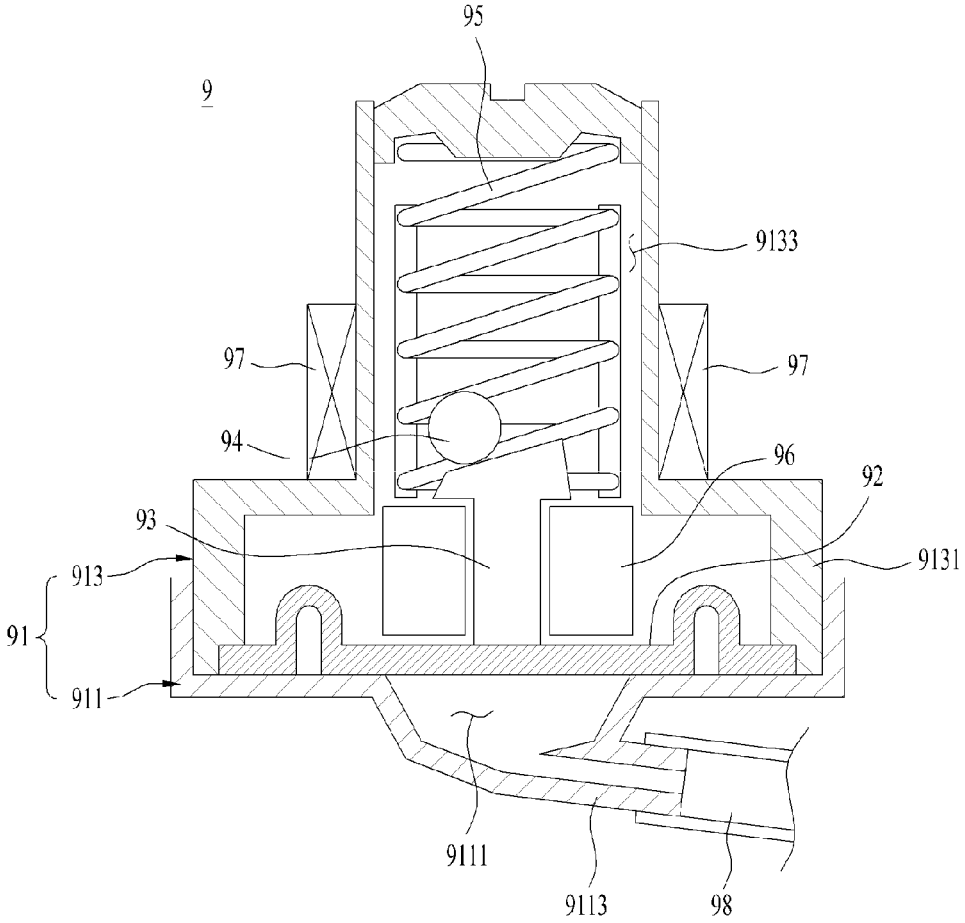
FIG. 2 is an example of a vibration sensor provided to the washing machine.

Further, the vibration sensor 9 may be configured as shown in FIG. 2 to check whether noise has been produced by electrical operation of the electronic equipment provided to the washing machine or physically produced by washing water remaining in the inner tub 4.

The vibration sensor 9 shown in FIG. 2 includes a housing 91 fixed to the cabinet 1 and adapted to communicate with the outer tub 3, and a sensor provided to the housing 91 to sense vibration of the cabinet 1 and change of water level in the outer tub 3.

The housing 91 may be provided with a lower housing 911 to communicate with the interior of the outer tub 3 through the connection pipe 98, and an upper housing 913 coupled to the lower housing 911.

The lower housing 911 may be formed in a cylindrical shape having an open upper surface. The closed lower surface of the lower housing 911 includes a through hole 9111 and a connector 9113 to connect the through hole 9111 with the connection pipe 98.

One end of the connection pipe 98 is connected to the connector 9113, and the other end thereof is connected to the bottom surface or lower end of the lateral surface of the outer tub 3 (see FIG. 1).

Further, the upper housing 913 may be provided with a fixing portion 9131 to fix a partition membrane 92 (e.g., a diaphragm), and an accommodation pipe 9133 extending from the fixing portion 9131.

The fixing portion 9131 and the accommodation pipe 9133 may be formed in the shape of a cylinder having a hollow inner space, and the accommodation pipe 9133 may have a diameter smaller than that of the fixing portion 9131 and may be connected to the upper portion of the fixing portion 9131.

The diaphragm 92, which senses change of the water level in the outer tub 3, is positioned in the housing 91.

The diaphragm 92 is arranged to cover the through hole 9111 by contacting the lower housing 911, but only the edge thereof is fixed to the lower housing 911 by the fixing portion 9131.

Accordingly, when the water level in the outer tub 3 changes, the pressure in the connection pipe 98 will change, and the diaphragm 92 ascends or descends in the housing 91 according to change of pressure in the connection pipe 98.

Also, the housing 91 includes therein a ball supporter 93 fixed to the diaphragm 92, a magnetic member 96 fixed to the ball supporter 93, a spring 95 provided in the accommodation pipe 9133 to elastically support the ball supporter 93 or the magnetic member 96, a ball 94 supported by the ball supporter 93, and a magnetic force sensing unit 97 provided on the outer circumferential surface of the accommodation pipe 9133 to sense magnetic force produced by the magnetic member 96.

One end of the ball supporter 93 is fixed to the diaphragm 92, and the other end thereof is inserted into the accommodation pipe 9133 of the upper housing 913. Accordingly, when the diaphragm 92 moves within the housing 91, the ball supporter 93 also moves in conjunction with the diaphragm 92.

One end of the spring 95 is fixed to the accommodation pipe 9133, and the other end thereof is connected to the magnetic member 96 or the ball supporter 93. Accordingly, even when the diaphragm 92 is caused to move in the housing 91 by change of the water level in the outer tub 3 or vibration of the cabinet 1, the diaphragm 92 and the ball supporter 93 may be returned to the positions shown in FIG. 2 by the spring 95.

Since the magnetic member 96 is fixed to the ball supporter 93, it moves together with the ball supporter 93 when the ball supporter 93 moves. The magnetic force sensing unit 97 senses the magnitude or change of magnetic force according to a position of the magnetic member 96 and provides the same to the controller.

The magnetic force between one magnetic member and another magnetic member tends to decrease as the distance between the magnetic members increases and tends to increase as the distance between the magnetic members decreases. Accordingly, the magnetic force sensing unit 97 may be formed in any shape that is capable of measuring increase or decrease in magnetic force according to change in position of the magnetic member 96.

The data provided from the magnetic force sensing unit 97 is transmitted to the controller. The controller determines the water level in the outer tub 3 and vibration of the cabinet 1 based on the magnetic force data. That is, the controller may create data related to vibration transferred to the cabinet 1 (vibration data such as, e.g., frequencies) based on the data provided from the magnetic force sensing unit 97.

In addition, the vibration sensor 9 having the ball supporter 93 fixed to the diaphragm 92 and the magnetic member 96 fixed to the ball supporter 93 may sensitively measure magnetic force according to change of water level in the outer tub 3, but may not sensitively measure change in magnetic force caused by vibration transferred to the outer tub 3 and the cabinet 1 during rotation of the inner tub 4.

Accordingly, the vibration sensor 9 further includes the ball 94 to sensitively measure change in magnetic force caused by vibration transferred to the outer tub 3 and the cabinet 1 during rotation of the inner tub 4.

The ball 94 may be formed of a magnetized material. In some implementations, the ball 94 is positioned at the upper portion of the ball supporter 93, but is not fixed to the ball supporter 93, such that it may freely move in the accommodation pipe 9133.

Accordingly, when the outer tub 3 and the cabinet 1 are caused to vibrate by rotation of the inner tub 4, the housing 91 fixed to the cabinet 1 will vibrate. When the housing 91 vibrates, the ball 94 supported by the ball supporter 93 will freely move in the accommodation pipe 9133.

In this case, the magnetic force sensing unit 97 may sense the change in magnetic force by the ball 94 and transmit the magnetic force data to the controller even when the ball supporter 93 and the magnetic member 96 move only slightly (e.g., even in the case that the cabinet vibrates, but there is no washing water in the outer tub 3 or little change of the water level in the outer tub). Therefore, the controller may estimate the extent of vibration of the cabinet 1.

Meanwhile, noise influencing the function of the vibration sensor 9 may be classified into electrical noise caused by electronic equipment provided in the washing machine 100 as described above, and physical noise caused by washing water in the outer tub 3.

The electrical noise is caused by the magnetic member 96 or the magnetic force sensing unit 97 influenced by electromagnetic waves generated when the drive unit 5, the water supply valve 61, and the drainage valve 71 or the drainage pump are turned on/off. The physical noise is caused by movement of the diaphragm 92 provided in the vibration sensor 9 when there is change of the water level of the washing water in the outer tub 3 or there is washing water remaining in the outer tub 3.

In the case of the physical noise, the magnetic force data sensed by the vibration sensor 9 is based on magnetic force sensed during movement of the diaphragm 92. In the case of the electrical noise, the magnetic force data is based on magnetic force sensed without movement of the diaphragm 92 or the ball 94. Therefore, the magnitude and change of the magnetic force due to the physical noise may be distinguished from those due to the electrical noise.

In addition, the ball 94 of the vibration sensor 9 moves when actual vibration is caused by rotation of the inner tub 4. In this case, the data of magnetic force sensed by the vibration sensor 9 is based on change in magnetic force according to movement of the ball 94, and therefore the magnitude and profile of change of the magnetic force in this case may be distinguished from those of the magnetic force caused by the above noises.

Accordingly, by establishing a reference to distinguish the magnitude and profile of change of magnetic force produced by noises from those produced by actual vibration, and a reference to distinguish the magnitude and profile of change of magnetic force produced by the physical noise from those produced by the electrical noise, actual vibration may be differentiated from noises, and the electrical noise may be differentiated from the physical noise.

Figure 3:
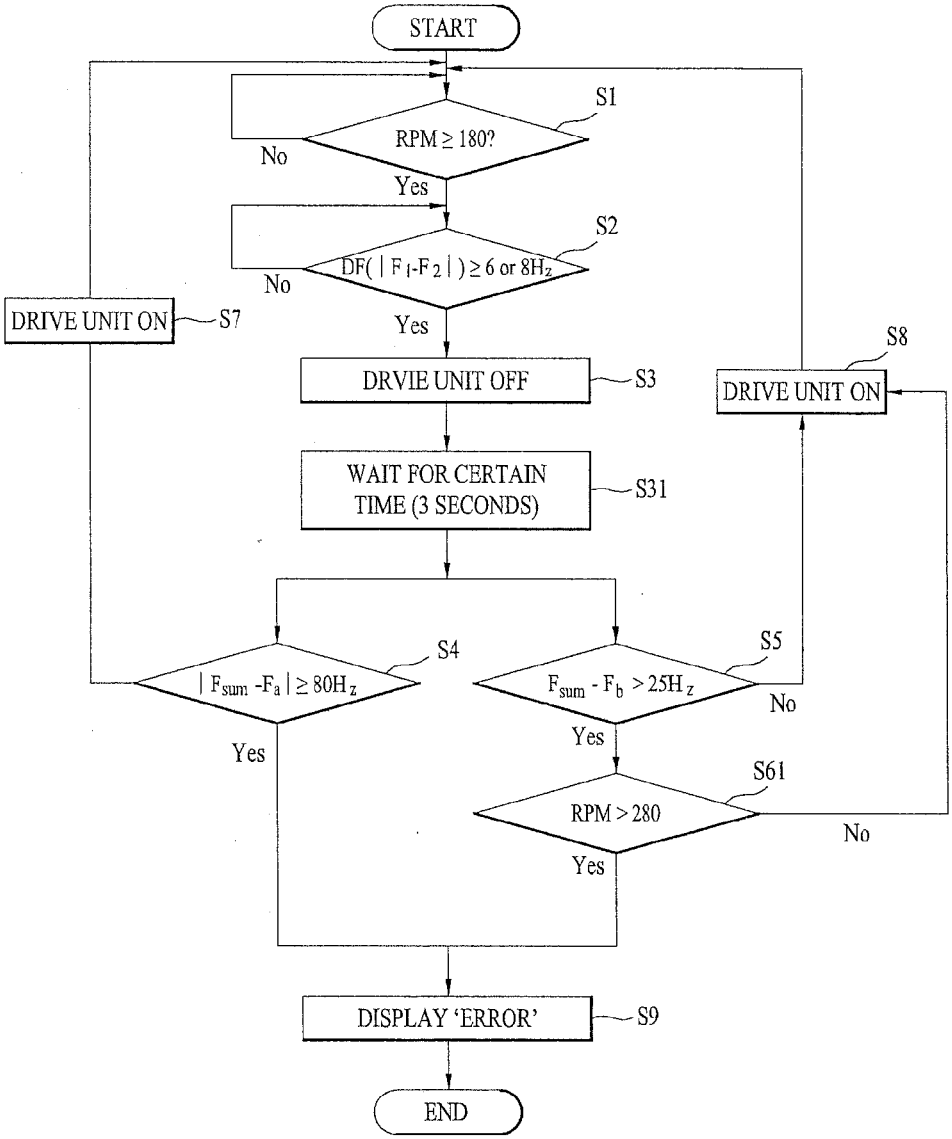
FIG. 3 is a flowchart illustrating an example control method for a washing machine.

FIG. 3 illustrates an example control method for a washing machine configured as above. In the control method for the washing machine, whether the vibration is produced by rotation of the inner tub 4 and the magnitude of the vibration are determined through the vibration sensor 9 and the controller. In the control method, it is possible to determine whether the vibration sensed by the vibration sensor 9 is noise or actual vibration caused by rotation of the inner tub 4.

In addition, in the control method for the washing machine, when the vibration sensed through the vibration sensor 9 and the controller is determined to be actual vibration caused by rotation of the inner tub 4, the vibration may be reduced or operation of the washing machine may be stopped, depending on the magnitude of the vibration In the control method for the washing machine, when the inner tub 4 rotates, the step of determining whether the revolutions per minute (RPM) of the inner tub 4 are equal to or greater than a first reference RPM value (S1, a first RPM determining step) is performed.

The step of determining whether the RPM of the inner tub 4 is equal to or greater than the first reference RPM value (S1) may be implemented by a sensor that measures the RPM of a rotating shaft 55 or a rotor 53, or the RPM of the inner tub 4.

That is, the step of determining whether the RPM of the inner tub 4 is equal to or greater than the first reference RPM value (S1) may be implemented when the controller receives the RPM data (the data by which the controller may determine the RPM) transmitted from a sensor (such as a hall effect sensor) for measurement of the RPM of the rotating shaft 55, the rotor 53, or the inner tub 4.

In addition, the first reference RPM value may be set to a value between 175 RPM to 185 RPM (for example, 180 RPM). Resonance of the washing machine, which depends upon the capacity of the washing machine, is generated in the RPM range of the inner tub 4 between 200 RPM and 220 RPM.

Accordingly, the first reference RPM value forms the basis of determining whether the RPM of the inner tub 4 falls in the range of resonance frequency at which large vibration occurs in the washing machine.

When it is determined that the RPM of the inner tub 4 is equal to or greater than the first reference RPM value, the step of determining whether the vibration of the cabinet 1 has increased or decreased beyond a reference frequency (S2) is performed.

The vibration sensor 9 provided to the washing machine measures the frequency (Hz) of the cabinet 1 with a particular time period (0.1 second or 0.5 second) and transmits the same to the controller. The controller creates vibration data (such as frequencies) based on the data provided from the vibration sensor 9 (alternatively, the vibration sensor 9 may measure the frequency of the cabinet 1 or the outer tub 3 and generate the vibration data).

In the step of determining whether or not to increase or decrease vibration of the cabinet 1 (S2), vibration increase/decrease data DF (vibration change data) is compared with the reference frequency (Hz). When the vibration increase/decrease data DF is equal to greater than the reference frequency, it is determined that vibration of the cabinet 1 is abnormally increasing.

Further, the vibration increase/decrease data DF may be set in various ways. In FIG. 3, the currently measured vibration data of the cabinet 1 is defined as a first element frequency F1 (or a first element number of vibrations), the vibration data of the cabinet 1 measured prior to the first element frequency F1 is defined as a second element frequency F2 (a second element number of vibrations), and the value obtained by subtracting F2 from F1 is set as the vibration increase/decrease data DF.

The first element frequency F1 may be defined as the sum of a certain number of vibration data measured prior to the current time (including the vibration date at the current time) (e.g., the sum of five instances of vibration data) among a plurality of vibration data that the vibration sensor 9 has measured during a particular time period. In this case, the second element frequency F2 may be defined as the sum of a certain number (the same number as the number of instances of the vibration data used to calculate the first element frequency F1) of data vibration data measured prior to the vibration data used to calculate the first element frequency F1.

Comparing one vibration datum F1 currently measured with another vibration datum F2 measured prior to the vibration data F1 may produce a small deviation, making it difficult to accurately determine whether vibration of the cabinet 1 increases or decreases.

Further, the reference frequency may be set to a value between 6 Hz and 8 Hz. The range of vibration increase/decrease data between 6 Hz and 8 Hz is a threshold which allows determining whether the vibration of the cabinet 1 has entered the section of abnormal vibration. This range has been obtained through experimentation.

The reference frequency may be set to 6 Hz while the RPM of the inner tub 4 is increasing. In the case that the RPM of the inner tub 4 is maintained within a certain range, the reference frequency may be set to 8 Hz.

That is, the reference frequency is set to 6 Hz in the case that the rate of increase of the RPM of the inner tub 4 is equal to or greater than the reference rate of increase before the step of interrupting supply of power to the drive unit (S3). The reference frequency is set to 8 Hz in the case that the rate of increase of the RPM of the inner tub 4 is less than the reference rate of increase.

The vibration of the cabinet 1 may drastically increase when the RPM of the inner tub 4 is increasing. On the other hand, when the RPM of the inner tub 4 is within a certain range, there is little risk of drastic increase of the vibration of the cabinet 1. Accordingly, the reference frequency needs to be set to a smaller value when the RPM of the inner tub 4 is outside of a certain range than when the RPM of the inner tub 4 is within the certain range.

When it is determined that the vibration increase/decrease data DF is equal to or greater than the reference frequency, the power supplied to the drive unit 5 is interrupted (S3), and then the inner tub 4 is allowed to rotate according to its own inertia for a certain time (S31).

The time for which the inner tub 4 rotates after the power to the drive unit 5 is interrupted may be set to a short time between about 3 seconds and about 4 seconds.

While the inner tub 4 is rotating according to its own inertia, the step of determining whether the vibration sensed by the vibration sensor 9 is sufficiently large to topple the washing machine 100 (S4, the toppling possibility determining step), and the step of determining whether the vibration sensed by the vibration sensor 9 is vibration caused by noise or actual vibration caused by rotation of the inner tub 4 (S5, the noise determining step) are performed.

The toppling possibility determining step S4 and the noise determining step S5 may be simultaneously performed or sequentially performed.

In the case that these steps are sequentially performed, the noise determining step S5 may be performed after the toppling possibility determining step S4. Alternatively, the toppling possibility determining step S4 may be performed after the noise determining step S5.

The noise determining step S5 may be performed by comparing the difference between a cumulative frequency F_sum and the reference sensing frequency Fa with the reference toppling frequency.

As described above, the vibration sensor 9 provided in the washing machine measures the frequency (Hz) of vibration of the cabinet 1 with a certain time period (0.1 second or 0.5 second) to create vibration data. Herein, the cumulative frequency F_sum is defined as the sum of the most recently measured vibration datum (the vibration datum at the current time) and a certain number of vibration data measured prior to the most recently measured vibration datum. Accordingly, the cumulative frequency F_sum is updated with a time period corresponding to the measurement period of vibration data or the renewal period of the cumulative frequency.

Also, the number of instances of vibration data used to calculate the cumulative frequency F_sum may be set to be equal to or greater than the number of instances of vibration data used to calculate the first element frequency described above.

The reference sensing frequency Fa is set to F_sum at the current time in the case that the difference between at least two calculated element frequencies is less than the reference incremental change (e.g., 2 Hz). The reference sensing frequency Fa is set to F_sum (F_sum0, see FIG. 4) measured immediately before the current time in the case that the difference between the element frequencies is equal to or greater than the reference incremental change. Accordingly, the reference sensing frequency Fa is also updated with a time period corresponding to the measurement period of vibration data or the renewal period of the element frequencies.

Figure 4:
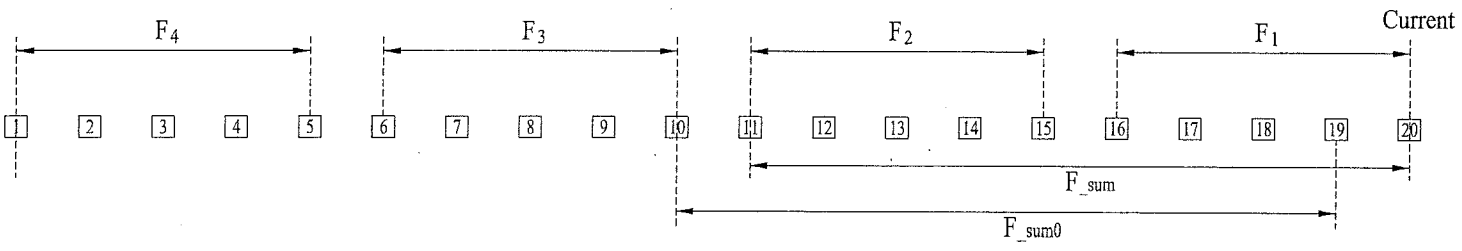
FIGS. 4 and 5 are views illustrating an example control method for measurement of data utilized for an example control method for a washing machine.

FIG. 4 illustrates an example method for measurement of vibration data by the vibration sensor 9 for calculation of the cumulative frequencies F_sum0 and F_sum, element frequencies F1 to F4, and the reference sensing frequency Fa, and a method for computation of the frequency data by the controller.

The vibration sensor 9 measures the number of vibrations of the cabinet 1 with a certain time period to create vibration data, and FIG. 4 shows vibration data measured with the certain time period after power to the drive unit 5 is interrupted (S3).

The numbers marked in squares, which represent vibration data, represent the order of vibration data, not the measured frequencies.

Suppose that the time at which the twentieth vibration datum is measured after power to the drive unit 5 is interrupted is the current time, each of the element frequencies F1 to F4 is set to the sum of five instances of vibration data, and the cumulative frequency F_sum is set to the sum of ten instances of vibration data measured before the current time (it may be set to the sum of ten instances of vibration data including the vibration data at the current time).

In this case, the first element frequency F1 is the sum of vibration data from vibration datum No. 16 to vibration datum No. 20 (the current vibration datum), the second element frequency F2 is the sum of vibration data from vibration datum No. 11 to vibration datum No. 15, and the cumulative frequency F_sum is the sum of vibration data from vibration datum No. 11 to vibration datum No. 20.

Figure 5:
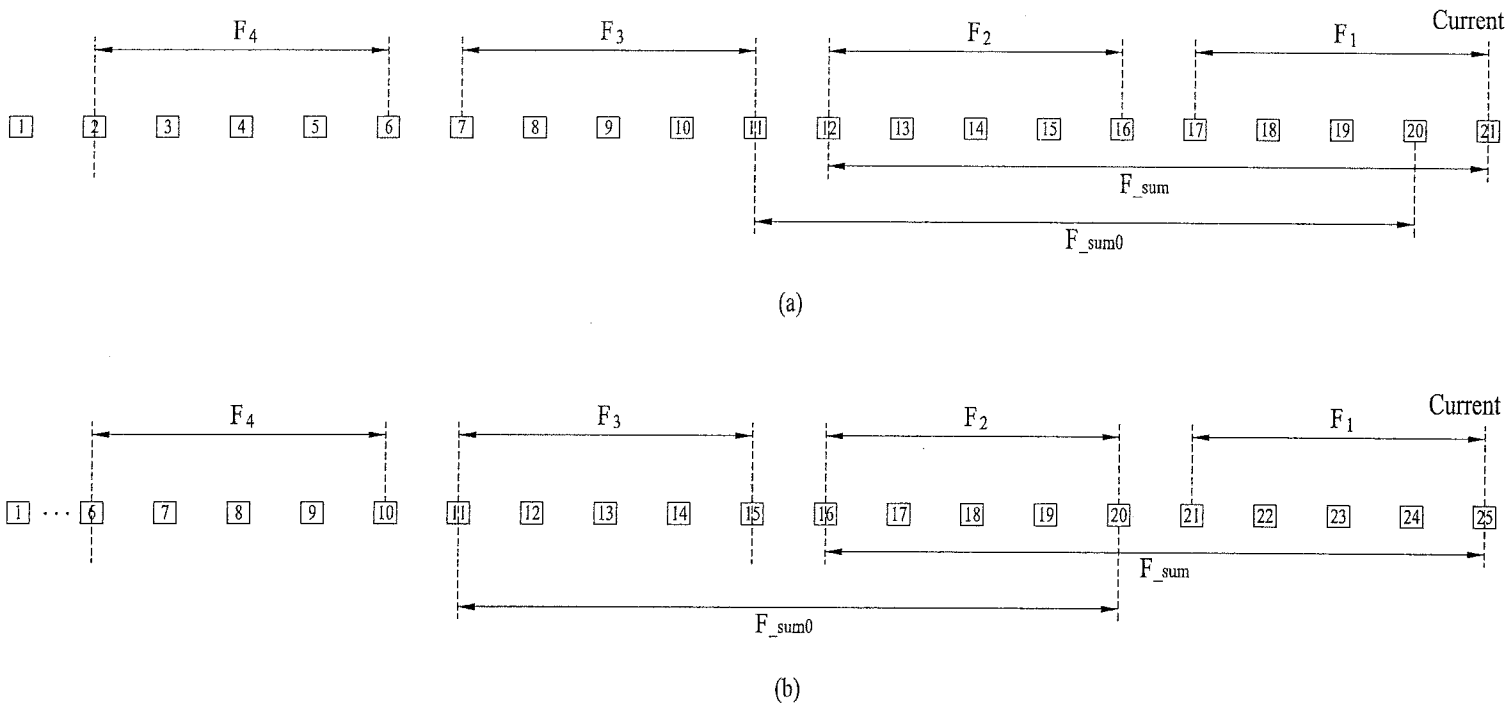

When the vibration sensor 9 measures vibration data with a time period of 0.1 second, the element frequencies and the cumulative frequency are set as shown in FIG. 5(*a*).

That is, the first element frequency F1 is the sum of vibration data from vibration datum No. 17 to vibration datum No. 21 (the current vibration datum), the second element frequency F2 is the sum of vibration data from vibration datum No. 12 to vibration datum No. 16, and the cumulative frequency F_sum is the sum of vibration data from vibration datum No. 12 to vibration datum No. 21.

In this case, the sum of vibration data from vibration datum No. 11 to vibration datum No. 20 is the cumulative frequency F_sum0 before the current time (the cumulative frequency immediately before the current time).

As described above, the reference sensing frequency Fa is set by comparing the difference between at least two element frequencies F1 and F2 with the reference value. Setting the reference sensing frequency Fa through comparison of two element frequencies is performed as follows.

In the case that the difference between the first element frequency F1 and the second element frequency F2 is less than the reference incremental change (e.g., 2 Hz), the cumulative frequency F_sum at the current time becomes the reference sensing frequency Fa. In the case that the difference between the first element frequency F1 and the second element frequency F2 is equal to or greater than the reference incremental change, the cumulative frequency (F_sum0) before the current time becomes the reference sensing frequency Fa.

In the case that the reference sensing frequency Fa is set by comparing at least two element frequencies, it may be set as follows.

As shown in FIG. 3, when the current time is the time at which vibration datum No. 20 is measured, and the measurement period of vibration data is 0.1 second, the cumulative frequency F_sum at the current time is the sum of vibration data from vibration datum No. 11 to vibration datum No. 20, the cumulative frequency F_sum0 before the current time is the sum of vibration data from vibration datum No. 10 to vibration datum No. 19.

In this case, the third element frequency F3 is the sum of five (the number of instances of vibration data used to set the first element frequency and the second element frequency) instances of vibration data among a plurality of vibration data measured before the second element frequency F2, and the fourth element frequency F4 is the sum of five instances of vibration data measured before the third element frequency F3.

In addition, the reference sensing frequency Fa may be set by comparing the difference between the greatest element frequency and the least element frequency among the four element frequencies F1 to F4 with the reference incremental change (e.g., 2 Hz).

That is, in the case that the difference between the greatest element frequency and the least element frequency is less than the reference value, the cumulative frequency F_sum at the current time is set to the reference sensing frequency Fa. In the case that the difference between the greatest element frequency and the least element frequency is equal to or greater than the reference value, the cumulative frequency F_sum0 before the current time is set to the reference sensing frequency Fa.

In the case that the vibration sensor 9 measures vibration data with the time period of 0.1 seconds, and the element frequency and the cumulative frequency are updated with the time period of 0.5 seconds, the element frequencies F1 to F4 and the cumulative frequency F_sum are set as shown in FIG. 5(*b*).

Figure 6:
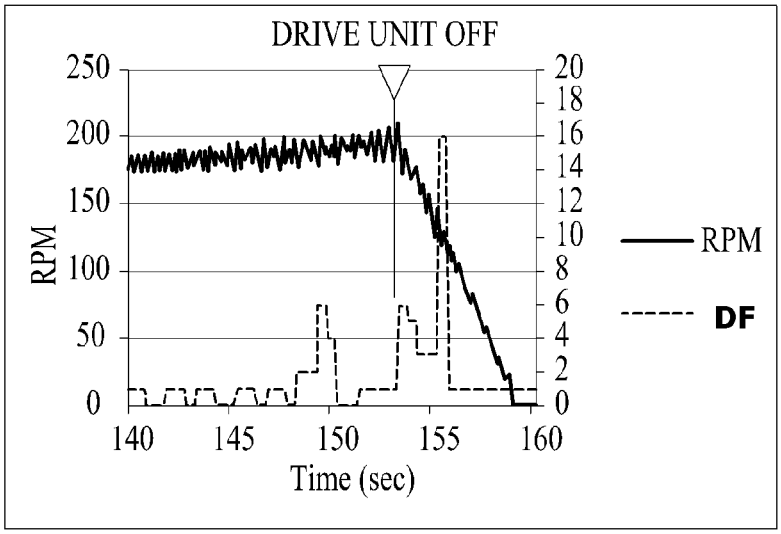
FIG. 6 shows an example of data measured in FIGS. 4 and 5.
Figure 6:
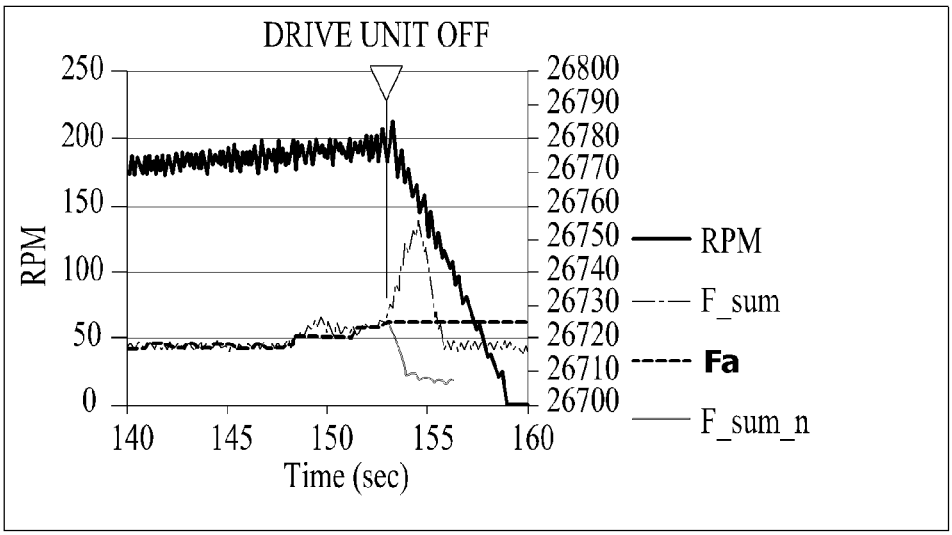

Accordingly, the cumulative frequency F_sum and the reference sensing frequency Fa measured in the above manner will have tendencies as shown in FIG. 6(*b*). The vibration increase/decrease data DF defined as the absolute value of the value obtained by subtracting the second element frequency F2 from the first element frequency F1 will have a tendency as shown in FIG. 6(*a*).

In the case that change of vibration occurring in the cabinet 1 is uniform (less than 2 Hz) as shown in FIG. 6(*b*), the reference sensing frequency Fa is equal to the cumulative frequency F_sum. In the case that the vibration occurring in the cabinet 1 drastically changes, the cumulative frequency (F_sum0) before the current time is maintained, and therefore the reference sensing frequency Fa is less than the cumulative frequency F_sum of the current time.

Accordingly, in the case that the value obtained by subtracting the reference sensing frequency Fa from the cumulative frequency F_sum is equal to or greater than the set reference value (the reference toppling frequency), this suggests drastic increase of vibration, and the risk of toppling of the washing machine 100 may be determined in advance through the toppling possibility determining step (S4).

More specifically, in the toppling possibility determining step (S4) shown in FIG. 3, the difference between the cumulative frequency F_sum and the reference sensing frequency Fa (the absolute value) is compared with the reference toppling frequency. In the case that the value obtained by subtracting the reference sensing frequency Fa from the cumulative frequency F_sum is equal to or greater than the reference toppling frequency, there is a risk of toppling of the washing machine. Therefore, 'ERROR' is displayed on the display unit 29, and the control operation is terminated.

In the case that the value obtained by subtracting the reference sensing frequency Fa from the cumulative frequency F_sum is less than the reference toppling frequency, however, there is a reduced risk (e.g., no risk) of toppling of the washing machine. Accordingly, power is resupplied to the drive unit 5 (S7) to perform the operation (such as drying) which was in progress before interruption of power to the drive unit (S3).

In addition, the reference toppling frequency used in the toppling possibility determining step (S4) may be set to a value within the range of from 75 Hz to 85 Hz. It has been found through experimentation that the risk of toppling of the washing machine can be most efficiently sensed when the reference toppling frequency is set to 80 Hz.

The noise determining step S5 and the toppling possibility determining step S4 may be simultaneously performed or sequentially performed. FIG. 3 shows the case in which the noise determining step S5 and the toppling possibility determining step S4 are simultaneously performed.

The noise determining step S5 is performed by comparing the difference between the cumulative frequency F_sum and the initial frequency Fb with the reference noise frequency.

According to experimentation, the profile of the cumulative frequency F_sum (the pattern of change of vibration data according to time) according to the actual vibration (the vibration caused by rotation of the inner tub) is distinguished from the profile of the cumulative frequency F_sum by noise.

As shown in FIG. 6(*b*), the profile of the cumulative frequency F_sum by actual vibration tends to increase after the power to the drive unit 5 is interrupted. On the other hand, the cumulative frequency F_sum by noise tends to decrease after the power to the drive unit 5 is interrupted.

In the case of actual vibration, the value of the cumulative frequency tends to temporarily increase since there is vibration transferred to the cabinet 1. By contrast, vibration data of noise sensed by the vibration sensor 9 is not the actual vibration that vibrates the cabinet 1, and therefore the cumulative frequency by noise tends to decrease.

Therefore, by setting an initial frequency Fb which allows determining whether the cumulative frequency F_sum increases or decreases after interruption of power to the drive unit 5, it may be possible to check whether the vibration sensed by the vibration sensor 9 is due to actual vibration or noise.

That is, in the noise determining step S5, the vibration sensed by the vibration sensor 9 may be determined to be actual vibration if the value obtained by subtracting the initial frequency Fb from the cumulative frequency F_sum is positive, while the vibration sensed by the vibration sensor 9 may be determined to have been caused by noise if the value obtained by subtracting the initial frequency Fb from the cumulative frequency F_sum is negative.

The cumulative frequency of sensed vibration data of noise may temporarily increase after interruption of power to the drive unit 5 for unknown reasons. Accordingly, the noise determining step S5 may be performed such that the vibration data is determined to have been produced by noise in the case that the difference between the cumulative frequency F_sum and the initial frequency Fb is less than the reference noise frequency, which is a positive value. The initial frequency Fb and the reference noise frequency described above may be set as follows.

The initial frequency Fb may be set to a cumulative frequency measured when the vibration data measured during rotation of the inner tub 4 is within a set range for a certain time.

Also, the greatest vibration occurs during the drying operation (dehydrating operation) of discharging the washing water in the laundry by rotating the inner tub 4.

Accordingly, the initial frequency Fb may be set to a cumulative frequency measured when the vibration data measured during rotation of the inner tub 4 after discharge of the washing water from the outer tub 3 through the drainage channel 7 is within a set range for a certain time.

Alternatively, the initial frequency Fb may be set to an experimental value of the cumulative frequency measured when the inner tub 4 stably rotates during the drying operation. That is, the initial frequency Fb may be preset to a value between 26710 Hz and 26720 Hz as shown in FIG. 6(*b*).

As shown in FIG. 6(*b*), the experimental value of the cumulative frequency F_sum measured when the inner tub 4 stably rotates is about 26720 Hz. Accordingly, by checking if the difference between the cumulative frequency F_sum measured after interruption of the power to the drive unit 5 and the initial frequency Fb of about 26720 Hz is less than the reference noise frequency, it can be checked whether the vibration sensed by the vibration sensor 9 is actual vibration or noise.

The reference noise frequency may be set to a value (e.g., 25 Hz) between 20 Hz and 30 Hz. According to experimentation, in the case that the difference between the cumulative frequency F_sum and the reference noise frequency is equal to or greater than 20 Hz and less than 30, it may be meaningfully determined whether the vibration sensed by the vibration sensor 9 has been caused by noise or actual vibration (if the difference between the cumulative frequency F_sum and the reference noise frequency is greater than 25 Hz, it is determined that the vibration is physical vibration caused by rotation of the inner tub 4).

In the noise determining step S5, in the case that the value obtained by subtracting the initial frequency Fb from the cumulative frequency F_sum of the current time is less than the reference noise frequency, it is determined that the vibration sensed by the vibration sensor 9 has been caused by noise (physical noise or electrical noise) and power is resupplied to the drive unit 5 (S8).

However, in the case that the value obtained by subtracting the initial frequency Fb from the cumulative frequency F_sum is greater than the reference noise frequency, it is determined that the vibration sensed by the vibration sensor 9 is actual vibration caused by rotation of the inner tub 4, and the step of comparing the RPM of the inner tub 4 before interruption of power to the drive unit 5 with a second reference RPM value (S61, a second RPM determining step) is performed.

The second reference RPM value may be set to a value between 275 RPM and 285 RPM (e.g., 280 RPM). The resonance of the washing machine, which may vary depending on the capacity of the washing machine as described above, usually occurs when the inner tub 4 rotates at an RPM between 200 RPM and 220 RPM.

The second reference RPM value is an RPM at which vibration corresponding to the reference toppling frequency is likely to be caused in the cabinet 1 when the RPM of the inner tub 4 is increased, even if the RPM of the inner tub 4 is out of the resonance frequency range of the washing machine.

Accordingly, in the control method shown in FIG. 3, in the case that the RPM of the inner tub 4 before interruption of power to the drive unit is greater than the second reference RPM value, 'ERROR' is displayed on the display unit 29. However, in the case that the RPM of the inner tub 4 before interruption of power to the drive unit is less than the second reference value, power is supplied to the drive unit 5 (S8) and the operation (such as the drying operation), which was in progress before interruption of power to the drive unit (S3), is performed.

To this end, when interrupting power to the drive unit (S3) is performed, the step of measuring the RPM of the inner tub 4 may be performed.

Figure 7:
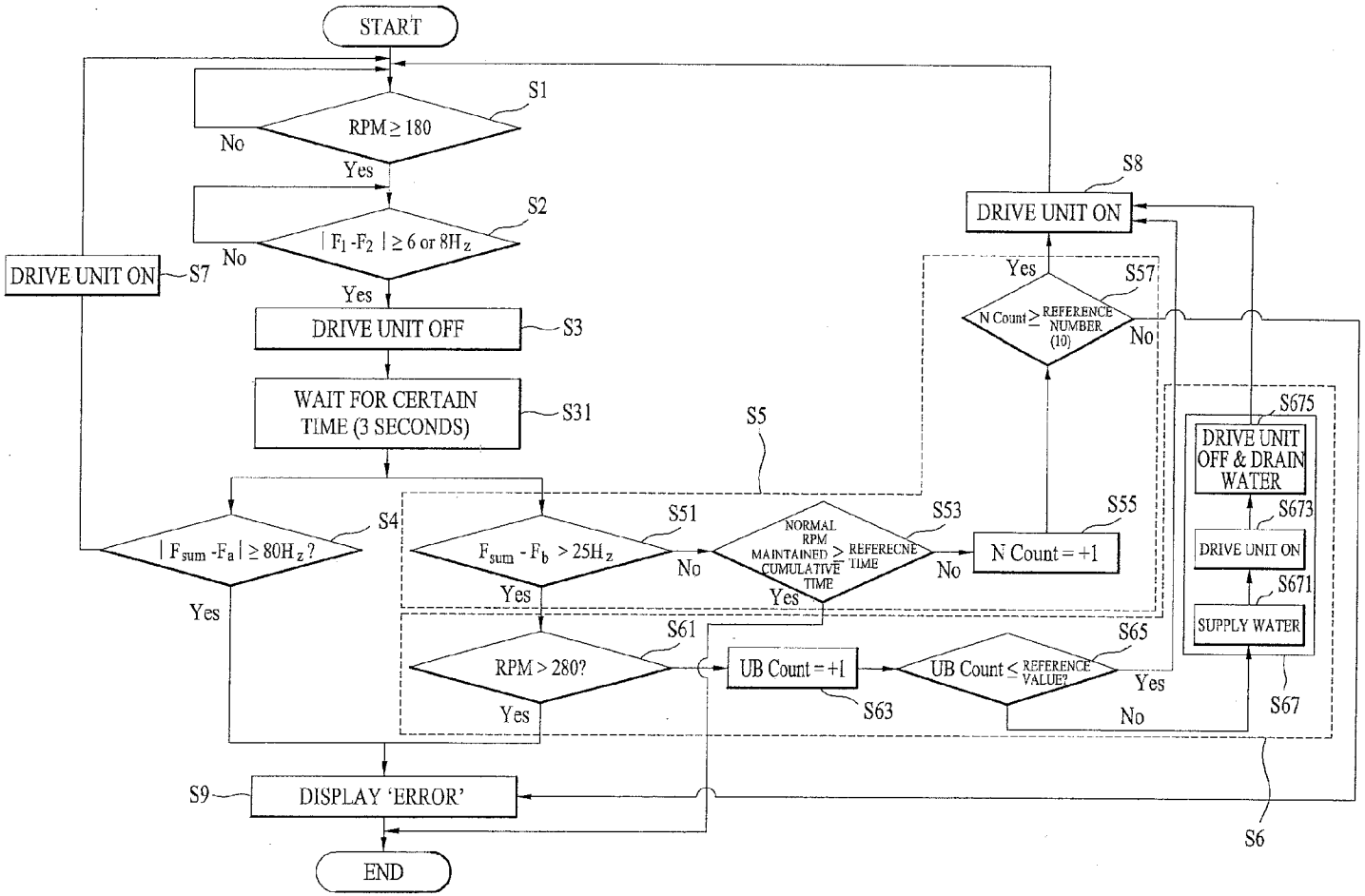
FIGS. 7 and 8 are views illustrating another example control method for a washing machine.

FIG. 7 illustrates an example control method for the washing machine. In the control method, the noise determining step S5 is shown in more detail than in FIG. 3, and an unbalance eliminating step S6 is added.

Hereinafter, a description will be given of the details of this control method that are different from those shown in FIG. 3.

In the control method, when power to the drive unit 5 is interrupted (S3), the noise determining step S5 is performed. In the noise determining step S5, the noise determining step S51 of comparing the difference between the cumulative frequency F_sum of the current time and the initial frequency Fb with the reference noise frequency (e.g., 25 Hz) is performed first.

Upon determining, in the noise determining step S51, that the vibration sensed by the vibration sensor 9 has been caused by noise, the step of determining whether the total time for which the inner tub 4 has rotated at an RPM equal to or greater than a predetermined normal RPM is equal to or greater than a reference time (S53, the accumulated time comparison step) is performed.

In the case of the control method shown in FIG. 3, the RPM of the inner tub 4 is compared with the first reference RPM value (S1), then it is determined whether the vibration increase/decrease data DF is equal to or greater than the reference frequency (S2), and power to the drive unit 5 is interrupted (S3).

Figure 8:
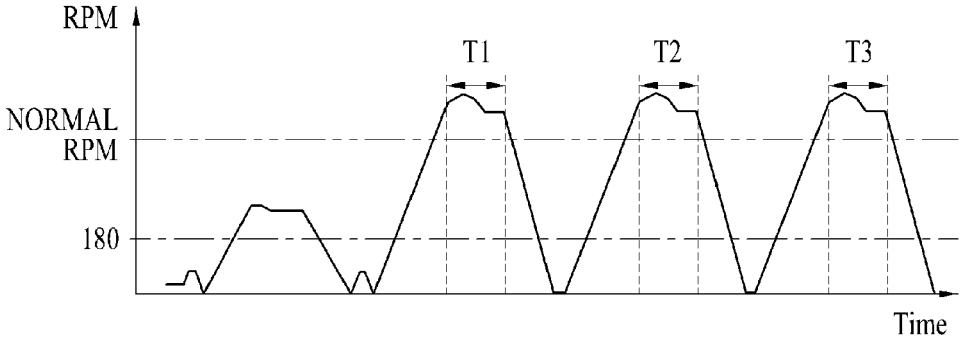

While the inner tub 4 is rotated due to inertia for a certain time after the power to the drive unit is interrupted, the vibration sensor 9 continues generating vibration data. In the case that the cumulative frequency F_sum of the current time is less than the reference noise frequency, power is resupplied to the drive unit (S8). Accordingly, FIG. 8 illustrates an example of changes in RPM of the inner tub 4 that occur during performance of steps S1, S2, S3, S5 and S8.

Accordingly, if steps S1, S2, S3, S5 and S8 continue to be repeated even when the inner tub 4 rotates for at least the reference time at an RPM (normal RPM) sufficiently high to wash or dry the laundry and thus the target operation is completed, the operational time of the washing machine 100 may excessively increase.

The accumulated time comparison step S53 may be provided to assist in reducing excessive increase. Thereby, in the case that the total time for which the inner tub 4 has rotated at an RPM equal to or greater than the normal RPM (the sum of T1, T2 and T3) is equal to or greater than the reference time, the operation of the washing machine 100 is terminated.

However, in the case that the total time for which the inner tub 4 has rotated at an RPM equal to or greater than the normal RPM is less than the reference time, the number of executions of the noise determining step (N Count) is updated (S55, the number of executions updating step). That is, when the noise determining step S5 has been performed for the first time, N Count will be 1. When the noise determining step S5 has been performed for the second time, N Count will be 2.

After the number of executions updating step S55 is performed, whether the number of executions of the noise determining step (N Count) is equal to or greater than a reference number (e.g., 10) is determined (S57). In the case that the number of executions of the noise determining step (N Count) is equal to or greater than the reference number, 'ERROR' is displayed on the display unit 29 (S9). In the case that the number of executions of the noise determining step (N Count) is less than the reference number, the step of supplying power to the drive unit 5 (S8) is performed.

It is not desirable for the number of executions of the noise determining step S5 to continue increasing even when the total time for which the inner tub 4 has rotated at the normal RPM (the accumulated time for which the normal RPM has been maintained) is less than the reference time since this increases power consumption and the operational time of the washing machine 100. In the case that the accumulated time for which the normal RPM has been maintained is less than the reference time even when the noise determining step S5 has been repeated a sufficient number of times for a sufficient time, it may be reasonable to consider the washing machine 100 has malfunctioned.

When it is determined in the noise determining step S51 that the vibration data measured by the vibration sensor 9 is the result of actual vibration, the unbalance eliminating step S6 is conducted.

The unbalance (UB) suggests that the laundry contained in the inner tub 4 is not uniformly distributed in the inner tub 4, instead being concentrated at a position within the inner tub 4.

When unbalance occurs in the inner tub 4, the inner tub 4 eccentrically rotates. In this process, large vibration occurs. Accordingly, operation as designed results when the inner tub 4 does not rotate in an unbalanced state.

In the unbalance eliminating step S6, the second RPM determining step S61 is first performed.

In the case that the vibration sensed by the vibration sensor 9 results from actual vibration due to rotation of the inner tub 4, and the RPM of the inner tub 4 measured through the second RPM determining step S61 when the power to the drive unit is interrupted is determined to be less than the second reference RPM value, the vibration of the inner tub 4 is most likely caused due to unbalance.

In the case that the RPM of the inner tub 4 had been maintained between 180 and 280 RPM during rotation before interruption of power to the drive unit (S3), vibration occurring in the cabinet 1 is determined to have a low (e.g., no) probability of toppling the washing machine and to have been caused by actual vibration rather than noise. In this case, unbalance of the inner tube 4 is often the cause of the vibration.

Accordingly, in the case that the RPM of the inner tub measured when the power to the drive unit is interrupted is less than the second reference RPM value (280 RPM), the number of times of sensing unbalance (UB Count) is updated (S63, the unbalance sensing times updating step). That is, when the second RPM determining step S61 has been executed for the first time, UB Count will have the value of 1. When the second RPM determining step S61 has been executed for the second time, UB Count will have the value of 2.

The unbalance of the inner tub 4 may be reduced (e.g., eliminated) through the laundry untangling step S67. Accordingly, in this example, it is determined whether the UB Count is greater than a reference number (a reference number of executions, e.g., 1) (S65). When UB Count is greater than the reference number, the laundry untangling step S67 of reducing (e.g., eliminating) unbalance is performed. When UB Count is equal to or less than the reference number, the laundry untangling step S67 is not performed and power is resupplied to the drive unit 5 (S8).

In the case that UB Count is equal to or less than the reference number (for example, when UB Count=1), unbalance of the inner tub 4 may be reduced (e.g., eliminated) solely by resupplying power to the drive unit 5 and rotating the inner tub 4. In the case that UB Count is greater than the reference number (for example, when UB Count=2), unbalance of the inner tub 4 needs to be actively eliminated through the laundry untangling step S67.

When washing water is not present in the inner tub 4 as in the drying operation, the laundry untangling step S67 may include supplying washing water to the inner tub 4 (S671, a water supply step), temporarily supplying power to the drive unit 5 and rotating the inner tub 4 (S673), interrupting power to the drive unit 5 and then draining the washing water from the inner tub 4 (S675).

In the step of temporarily supplying power to the drive unit 5 and rotating the inner tub 4 (S673), the inner tub 4 may rotate either clockwise or counterclockwise. Alternatively, the inner tub 4 may rotate clockwise and counterclockwise.

In the case that washing water is contained in the inner tub 4 as in the washing operation or rinsing operation, the laundry untangling step S67 may be sufficiently performed simply by rotating the inner tub 4.

The control method of a washing machine shown in FIGS. 3 and 7 has been described assuming that it is applied to a top loading type washing machine shown in FIG. 1. The control method may also be applicable to a front loading type washing machine.

That is, in the case that the front loading type washing machine includes a cabinet, a tub provided in the cabinet to contain washing water, a drum rotatably provided in the tub to contain objects to be washed and having a rotating shaft arranged not to be perpendicular to the bottom surface of the cabinet, a drive unit provided to the exterior of the tub to rotate the drum, and a vibration sensing unit provided to the cabinet or the tub to measure vibration occurring during rotation of the drum, the control method of FIGS. 3 and 7 may also be applicable to the front loading type washing machine.

A washing machine and a control method for the same according to implementations described above may address problems caused by vibration occurring during rotation of the inner tub. For example, disclosed techniques may prevent separation of the outer tub from the cabinet or opening of the door of the washing machine even when vibration occurs during rotation of the inner tub.

In another example, disclosed techniques may measure vibration occurring during rotation of the inner tub to determine whether the measured vibration has been caused by electrical noise or physically caused by rotation of the inner tub.

Further, in the case that the vibration occurring in the cabinet or the outer tub has been caused by rotation of the inner tub, a control operation may be performed to address causes of vibration or to prevent the washing machine from toppling over.

To achieve these objects and other advantages and in accordance with the purpose of the invention, as embodied and broadly described herein, a control method for a washing machine includes periodically measuring vibration occurring in a cabinet forming an external appearance of the washing machine or in an outer tub provided in the cabinet to contain washing water and creating vibration data for each period, determining whether vibration increase/decrease data is equal to or greater than a predetermined reference frequency, the vibration increase/decrease data being defined as a magnitude of a value obtained by subtracting a second element frequency (F2) from a first element frequency (F1), interrupting power to a drive unit for rotating the inner tub when the vibration increase/decrease data is equal to or greater than the reference frequency, and determining noise, the noise determining step including resupplying power to the drive unit when a value obtained by subtracting an initial frequency from a cumulative frequency (F_sum) is less than a predetermined reference noise frequency, and displaying information indicating occurrence of an error through an alarm unit provided to the washing machine when the value obtained by subtracting the initial frequency from the cumulative frequency is equal to or greater than the reference noise frequency.

F1 is a most recently created vibration datum (a vibration datum of the current time) or a sum of a predetermined number of vibration data including the most recently created vibration datum (an element frequency of the current time), F2 is a vibration datum created prior to the first element frequency or a sum of vibration data created prior to the first element frequency, the number of the vibration data being identical to the predetermined number of the vibration data necessary for calculation of the first element frequency, F_sum (a cumulative frequency of the current time) is a sum of vibration data, the number of the vibration data being equal to or greater than the number of the vibration data necessary for calculation of the first element frequency including the most recently created vibration datum, and F1, F2, and F_sum are updated according to a period of creation of the vibration data.

Herein, the reference frequency may be set to 6 Hz when a rate of increase of revolutions per minute (RPM) of the inner tube before the interrupting step is equal to or greater than a reference rate of increase, and may be set to 8 Hz when a rate of increase of revolutions per minute (RPM) of the inner tube before the interrupting step is less than a reference rate of increase.

The initial frequency may be a cumulative frequency measured when the vibration data measured during rotation of the inner tub is within a predetermined range for a certain time.

The control method may further include a first revolutions per minute (RPM) determining step of determining whether an RPM of the inner tub is equal to or greater than a first reference RPM value, wherein the step of determining whether the vibration increase/decrease data is equal to or greater than a predetermined reference frequency may be performed when the RPM of the inner tub is equal to or greater than the first reference RPM value.

The noise determining step may further include comparing a total time for which the inner tub has rotated at an RPM equal or greater than a normal RPM with a predetermined accumulated time, when a value obtained by subtracting the initial frequency (Fb) from the cumulative frequency (F_sum) is less than the reference noise frequency, wherein the resupplying step may be performed when the total time for which the inner tub has rotated at the RPM equal or greater than the normal RPM is less than the accumulated time, and operation of the washing machine may be terminated when the total time for which the inner tub has rotated at the RPM equal or greater than the normal RPM is equal or greater than the accumulated time.

The noise determining step may further include updating the number of executions of the noise determining step when the total time for which the inner tub has rotated at the RPM equal or greater than the normal RPM is less than the accumulated time, wherein the information indicating occurrence of an error may be displayed through the alarm unit when the updated number of executions is equal to or greater than a predetermined reference number, and the resupplying step may be performed when the updated number of executions is less than the reference number.

The control method may further includes a second RPM determining step of comparing the RPM of the inner tub measured before the power to the drive unit is interrupted with a predetermined second reference RPM value when the value obtained by subtracting the initial frequency (Fb) from the cumulative frequency (F_sum) is equal to or greater than the reference noise frequency, wherein the displaying step may be preformed when the RPM of the inner tub measured before the power to the drive unit is interrupted is greater than the second reference RPM value.

The resupplying step may be performed when the RPM of the inner tub measured before the power to the drive unit is interrupted is equal to or less than the second reference RPM value.

The control method may further include a laundry untangling step of eliminating unbalance in the inner tub when the RPM of the inner tub measured before the power to the drive unit is interrupted is equal to or less than the second reference RPM value, wherein the resupplying step may be performed after the laundry untangling step is terminated.

The laundry untangling step may include supplying the washing water to the outer tub, supplying the power to the drive unit and rotating the inner tub, and interrupting the power supplied to the drive unit and discharging the washing water from the outer tub.

The control method may further include updating the number of times of sensing the unbalance when the RPM of the inner tub measured before the power to the drive unit is interrupted is equal to or less than the second reference RPM value, wherein the laundry untangling step may be performed when the number of times of sensing is greater than a predetermined reference number of executions, and the resupplying step is performed when the number of times of sensing is equal to or less than the reference number of executions.

The control method may further include displaying the information indicating occurrence of an error through the alarm unit when an incremental change of the cumulative frequency updated according to a period of creation of the vibration data is equal to or greater than a predetermined reference toppling frequency, and resupplying the power to the drive unit when the incremental change of the cumulative frequency is less than the reference toppling frequency.

The incremental change of the cumulative frequency may be measured as a magnitude of a value obtained by subtracting a reference sensing frequency (Fa) from the cumulative frequency (F_sum), the reference sensing frequency may be set to a value obtained by subtracting a least element frequency from a greatest element frequency among two or more element frequencies, the reference sensing frequency may be set to a cumulative frequency at a current time when the reference sensing frequency is less than a predetermined reference value of incremental change, and the reference sensing frequency may be set to a cumulative frequency before the current time when the reference sensing frequency is equal to or greater than the reference value of incremental change and updated according to the period of creation of the vibration data.

In addition, the incremental change of the cumulative frequency may be measured as a magnitude of a value obtained by subtracting a reference sensing frequency (Fa) from the cumulative frequency (F_sum), and the reference sensing frequency to a value obtained by subtracting a least element frequency from a greatest element frequency among two or more element frequencies comprises setting the reference sensing frequency to the value obtained by subtracting the least element frequency from the greatest element frequency among the first element frequency, the second element frequency, a third element frequency, and a fourth element frequency, wherein, the third element frequency is defined as a sum of the number of vibration data used to set the first element frequency among a plurality of vibration date measured prior to the second element frequency, and the fourth element frequency is defined as a sum of the number of vibration data used to set the first element frequency among a plurality of vibration date measured prior to the third element frequency.

It will be apparent to those skilled in the art that various modifications and variations can be made without departing from the spirit or scope of the disclosure. Thus, the present disclosure covers modifications and variations that come within the scope of the appended claims and their equivalents.

What is claimed is:

1. A control method for a washing machine comprising:

periodically measuring vibration occurring in at least one of a cabinet of the washing machine and an outer tub provided in the cabinet to receive washing water;

based on the periodic measurement of vibration, determining a first element frequency using first vibration data and determining a second element frequency using second vibration data, the first vibration data being different than the second vibration data, the first vibration data including vibration data measured after all of the second vibration data, and the second vibration data including vibration data measured prior to all of the first vibration data;

determining vibration change data as a magnitude of a value obtained by subtracting the second element frequency from the first element frequency;

determining whether the vibration change data meets a predetermined reference frequency;

interrupting power to a drive unit for rotating an inner tub of the washing machine based on a determination that the vibration change data meets the reference frequency; and accounting for whether the vibration change data meeting the reference frequency was caused by noise by:

determining a cumulative frequency as a sum of most recently measured vibration data and a certain number of vibration data measurements that occurred prior to the most recently measured vibration data;

determining an initial frequency which allows determining whether the cumulative frequency increases or decreases after interruption of power to the drive unit;

determining a value obtained by subtracting the initial frequency from the cumulative frequency;

determining whether the value obtained by subtracting the initial frequency from the cumulative frequency meets a predetermined reference noise frequency;

resupplying power to the drive unit based on a determination that the value obtained by subtracting the initial frequency from the cumulative frequency does not meet the predetermined reference noise frequency; and displaying information indicating occurrence of an error through an alarm unit associated with the washing machine based on a determination that the value obtained by subtracting the initial frequency from the cumulative frequency meets the predetermined reference noise frequency.

2. The control method according to claim 1, further comprising:

determining, prior to interrupting power to the drive unit, a rate of increase of revolutions per minute of the inner tub;

determining whether the rate of increase of revolutions per minute of the inner tub meets a reference rate of increase; and based on a determination that the rate of increase of revolutions per minute of the inner tub meets the reference rate of increase, setting the predetermined reference frequency to 6 Hz.

3. The control method according to claim 1, further comprising:

determining, prior to interrupting power to the drive unit, a rate of increase of revolutions per minute of the inner tub;

determining whether the rate of increase of revolutions per minute of the inner tub meets a reference rate of increase; and based on a determination that the rate of increase of revolutions per minute of the inner tub does not meet the reference rate of increase, setting the predetermined reference frequency to 8 Hz.

4. The control method according to claim 1, wherein determining the initial frequency corresponding to the time at which power to the drive unit was interrupted comprises determining the initial frequency as a cumulative frequency measured based on vibration data measured during rotation of the inner tub being within a predetermined range for a certain time.

5. The control method according to claim 1, further comprising determining whether revolutions per minute (RPM) of the inner tub meets a first reference RPM value, wherein determining whether the vibration change data meets the predetermined reference frequency is performed based on a determination that the RPM of the inner tub meets the first reference RPM value.

6. The control method according to claim 5, further comprising:

based on a determination that the value obtained by subtracting the initial frequency from the cumulative frequency does not meet the predetermined reference noise frequency, comparing a total time for which the inner tub has rotated at an RPM that meets a normal RPM value with a predetermined accumulated time; and terminating operation of the washing machine based on a determination that total time for which the inner tub has rotated at an RPM that meets the normal RPM value meets the predetermined accumulated time, wherein resupplying power to the drive unit comprises resupplying power to the drive unit based on a determination that total time for which the inner tub has rotated at an RPM that meets the normal RPM value does not meet the predetermined accumulated time.

7. The control method according to claim 6, further comprising updating a number of executions of resupplying power to the drive unit based on a determination that total time for which the inner tub has rotated at an RPM that meets the normal RPM value does not meet the predetermined accumulated time, and determining whether the updated number of executions meets a predetermined reference number of executions, wherein resupplying power to the drive unit comprises resupplying power to the drive unit based on a determination that the updated number of executions does not meet the predetermined reference number of executions, and wherein displaying information indicating occurrence of an error through the alarm unit comprises displaying information indicating occurrence of an error through the alarm unit based on a determination that the updated number of executions meets the predetermined reference number of executions.

8. The control method according to claim 5, further comprising comparing an RPM of the inner tub measured before the power to the drive unit is interrupted with a predetermined second reference RPM value based on a determination that the value obtained by subtracting the initial frequency from the cumulative frequency meets the predetermined reference noise frequency, wherein displaying information indicating occurrence of an error through the alarm unit comprises displaying information indicating occurrence of an error through the alarm unit based on the comparison revealing that the RPM of the inner tub measured before the power to the drive unit is interrupted is greater than the second reference RPM value.

9. The control method according to claim 8, wherein resupplying power to the drive unit comprises resupplying power to the drive unit based on the comparison revealing that the RPM of the inner tub measured before the power to the drive unit is interrupted is equal to or less than the second reference RPM value.

10. The control method according to claim 8, further comprising performing an operation directed to reducing unbalance in the inner tub based on the comparison revealing that the RPM of the inner tub measured before the power to the drive unit is interrupted is equal to or less than the second reference RPM value, wherein resupplying power to the drive unit comprises resupplying power to the drive unit after termination of the operation directed to reducing unbalance in the inner tub.

11. The control method according to claim 10, wherein performing the operation directed to reducing unbalance in the inner tub comprises:

supplying washing water to the outer tub;

supplying power to the drive unit and rotating the inner tub; and interrupting the power supplied to the drive unit and discharging the washing water from the outer tub.

12. The control method according to claim 11, further comprising:

updating a number of times of sensing unbalance based on the comparison revealing that the RPM of the inner tub measured before the power to the drive unit is interrupted is equal to or less than the second reference RPM value, and determining whether the number of times of sensing unbalance meets a predetermined reference number of times, wherein performing the operation directed to reducing unbalance in the inner tub comprises performing the operation directed to reducing unbalance in the inner tub based on a determination that the number of times of sensing unbalance meets the predetermined reference number of times, and wherein resupplying power to the drive unit comprises resupplying power to the drive unit based on a determination that the number of times of sensing unbalance does not meet the predetermined reference number of times.

13. The control method according to claim 1, further comprising:

determining an incremental change of the cumulative frequency as updated according to a period of creation of vibration data; and determining whether the incremental change of the cumulative frequency as updated according to the period of creation of vibration data meets a predetermined reference toppling frequency, wherein resupplying power to the drive unit comprises resupplying power to the drive unit based on a determination that the incremental change of the cumulative frequency as updated according to the period of creation of vibration data does not meet the predetermined reference toppling frequency, and wherein displaying the information indicating occurrence of an error through the alarm unit comprises displaying the information indicating occurrence of an error through the alarm unit based on a determination that the incremental change of the cumulative frequency as updated according to the period of creation of vibration data meets the predetermined reference toppling frequency.

14. The control method according to claim 13, further comprising:

setting a reference sensing frequency to a value obtained by subtracting a least element frequency from a greatest element frequency among two or more element frequencies;

wherein determining the incremental change of the cumulative frequency as updated according to the period of creation of vibration data comprises determining the incremental change of the cumulative frequency as a magnitude of a value obtained by subtracting the reference sensing frequency from the cumulative frequency.

15. The control method according to claim 14, further comprising:

determining whether the reference sensing frequency meets a predetermined reference value of incremental change; and updating the reference sensing frequency according to the period of creation of the vibration data, wherein setting the reference sensing frequency to a value obtained by subtracting a least element frequency from a greatest element frequency among two or more element frequencies comprises setting the reference sensing frequency to a cumulative frequency at a current time based on a determination that the reference sensing frequency does not meet predetermined reference value of incremental change; and wherein setting the reference sensing frequency to a value obtained by subtracting a least element frequency from a greatest element frequency among two or more element frequencies comprises setting the reference sensing frequency to a cumulative frequency before the current time based on a determination that the reference sensing frequency meets the reference value of incremental change.

16. The control method according to claim 14, wherein setting the reference sensing frequency to a value obtained by subtracting a least element frequency from a greatest element frequency among two or more element frequencies comprises:

setting the reference sensing frequency to the value obtained by subtracting the least element frequency from the greatest element frequency among the first element frequency, the second element frequency, a third element frequency, and a fourth element frequency, wherein, the third element frequency is defined as a sum of the number of vibration data used to set the first element frequency among a plurality of vibration date measured prior to the second element frequency, and wherein the fourth element frequency is defined as a sum of the number of vibration data used to set the first element frequency among a plurality of vibration date measured prior to the third element frequency.

17. The control method according to claim 1, wherein determining whether the vibration change data meets the predetermined reference frequency comprises determining whether the vibration change data is equal to or greater than the predetermined reference frequency.

18. The control method according to claim 1, wherein determining whether the value obtained by subtracting the initial frequency from the cumulative frequency meets the predetermined reference noise frequency comprises determining whether the value obtained by subtracting the initial frequency from the cumulative frequency is equal to or greater than the predetermined reference noise frequency.

19. The control method according to claim 1, wherein periodically measuring vibration occurring in at least one of the cabinet of the washing machine and the outer tub provided in the cabinet to receive washing water comprises periodically measuring vibration occurring in the outer tub provided in the cabinet to receive washing water.

20. A washing machine comprising:

a cabinet;

an outer tub provided in the cabinet to receive washing water;

an inner tub provided in the outer tub;

a drive unit for rotating the inner tub; and a vibration sensor configured to periodically measure vibration occurring in at least one of the cabinet of the washing machine and the outer tub provided in the cabinet to receive washing water, wherein the washing machine is configured to:

based on the periodic measurement of vibration, determine a first element frequency using first vibration data and determine a second element frequency using second vibration data, the first vibration data being different than the second vibration data, the first vibration data including vibration data measured after all of the second vibration data, and the second vibration data including vibration data measured prior to all of the first vibration data;

determine vibration change data as a magnitude of a value obtained by subtracting the second element frequency from the first element frequency;

determine whether the vibration change data meets a predetermined reference frequency;

interrupt power to the drive unit for rotating the inner tub of the washing machine based on a determination that the vibration change data meets the reference frequency; and account for whether the vibration change data meeting the reference frequency was caused by noise by:

determining a cumulative frequency as a sum of most recently measured vibration data and a certain number of vibration data measurements that occurred prior to the most recently measured vibration data;

determining an initial frequency which allows determining whether the cumulative frequency increases or decreases after interruption of power to the drive unit;

determining a value obtained by subtracting the initial frequency from the cumulative frequency;

determining whether the value obtained by subtracting the initial frequency from the cumulative frequency meets a predetermined reference noise frequency;

resupplying power to the drive unit based on a determination that the value obtained by subtracting the initial frequency from the cumulative frequency does not meet the predetermined reference noise frequency; and displaying information indicating occurrence of an error through an alarm unit associated with the washing machine based on a determination that the value obtained by subtracting the initial frequency from the cumulative frequency meets the predetermined reference noise frequency.

* * * * *